US007993163B2

(12) United States Patent
Wu et al.

(10) Patent No.: US 7,993,163 B2
(45) Date of Patent: Aug. 9, 2011

(54) MODULAR JACK CONNECTOR HAVING IMPROVED MAGNETIC MODULE

(75) Inventors: Li-Chun Wu, Tu-Cheng (TW); Chao-Tung Huang, Tu-Cheng (TW); Yueh-Shan Shih, Tu-Cheng (TW); Jie Zhang, Kunshan (CN); Yong-Chun Xu, Kunshan (CN); Jian-She Hu, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/769,686

(22) Filed: Apr. 29, 2010

(65) Prior Publication Data

US 2010/0279549 A1 Nov. 4, 2010

(30) Foreign Application Priority Data

Apr. 29, 2009 (CN) ..... 2009 1 0301948

(51) Int. Cl.
*H01R 13/66* (2006.01)

(52) U.S. Cl. ..... 439/620.06

(58) Field of Classification Search ..... 439/620.06, 439/620.11, 620.12, 620.15–620.19, 620.05
See application file for complete search history.

(56) References Cited

U.S. PATENT DOCUMENTS

| | | | | |
|---|---|---|---|---|
| 5,781,091 | A | 7/1998 | Krone et al. | |
| 5,926,003 | A * | 7/1999 | Morita | 320/107 |
| 6,431,916 | B1 * | 8/2002 | Asao | 439/620.05 |
| 6,568,966 | B1 * | 5/2003 | Korsunsky et al. | 439/676 |
| 6,752,664 | B2 * | 6/2004 | Hyland et al. | 439/620.05 |
| 6,786,772 | B1 * | 9/2004 | Liu | 439/620.06 |
| 6,926,558 | B2 | 8/2005 | Sasai et al. | |
| 7,540,747 | B2 * | 6/2009 | Ice et al. | 439/79 |
| 7,661,994 | B2 * | 2/2010 | Machado et al. | 439/676 |
| 7,670,183 | B2 * | 3/2010 | Huang et al. | 439/620.05 |
| 7,708,594 | B2 * | 5/2010 | Xu | 439/620.05 |
| 7,708,595 | B2 * | 5/2010 | Chow et al. | 439/620.15 |
| 7,749,027 | B2 * | 7/2010 | Chow et al. | 439/620.15 |
| 2007/0063807 | A1 | 3/2007 | Quilici | |
| 2007/0111598 | A1 | 5/2007 | Quilici | |
| 2007/0126542 | A1 * | 6/2007 | He et al. | 336/83 |
| 2008/0186124 | A1 | 8/2008 | Schaffer | |
| 2008/0248694 | A1 * | 10/2008 | Togami et al. | 439/620.05 |
| 2009/0002111 | A1 | 1/2009 | Harrison | |
| 2009/0176408 | A1 * | 7/2009 | Wu | 439/607.01 |
| 2009/0243757 | A1 * | 10/2009 | Xu et al. | 333/177 |
| 2009/0253299 | A1 * | 10/2009 | Zhang et al. | 439/607.55 |
| 2009/0253300 | A1 * | 10/2009 | Huang et al. | 439/620.05 |
| 2010/0279549 | A1 * | 11/2010 | Wu et al. | 439/620.05 |

* cited by examiner

*Primary Examiner* — T C Patel
*Assistant Examiner* — Vladimir Imas
(74) *Attorney, Agent, or Firm* — Ming Chieh Chang; Wei Te Chung; Andrew C. Cheng

(57) ABSTRACT

A modular jack connector (100) includes a contact module (2) having a paddle board (21) and a magnetic module (23). The magnetic module includes a number of magnetic cores (231) embedded in the paddle board, and a number of PCB layout traces (232, 233) arranged in each side face of the paddle board. The PCB layout traces on each side face includes a primary group of PCB layout traces (232*a*, 233*a*) having one group of tips (2322, 2331) extending to a position adjacent to corresponding magnetic core to form a magnetic field and another group of tips (2321, 2332) connected to a conductive section (2111, 2121) of the paddle board, and a secondary group of PCB layout traces (232*b*, 233*b*) having one group of tips (2323, 2333) extending to a position adjacent to corresponding magnetic core to form a magnetic field and another group of tips (2324, 2334) connected to vias of the paddle board.

6 Claims, 6 Drawing Sheets

MODULAR JACK CONNECTOR HAVING IMPROVED MAGNETIC MODULE

BACKGROUND OF THE INVENTION

1. Field of the Invention

The present invention relates to a modular jack connector, and more particularly to a modular jack connector having improved magnetic module having improved characteristics under a simple configuration.

2. Description of Related Art

U.S. Patent Application Publication No. 2009/0176408 published on Jul. 9, 2009 discloses an electrical connector comprising an insulative housing defining a cavity, a contact module received in the insulative housing, a shielding cage mounted on the insulative housing. The contact module comprises a paddle board having a first and a second side faces, a plurality of contacts mounted at the first side face of the paddle board and electrically connected with the paddle board, a plurality of magnetic modules mounted on the second side face of the paddle board, and a converting module carrying a plurality of converting contacts mounted at the second side face of the paddle board. The paddle board has a plurality of through holes extending through the first and second side faces. The converting contacts of the converting module are inserted through the through holes. The magnetic module comprises a magnetic core and a plurality of wires winding around the magnetic core.

The magnetic module is formed by winding a plurality of coils around a magnetic core. Such a magnetic module is then soldered to the paddle board directly or through a base with conductive pins.

U.S. Patent Application Publication No. 2008/0186124 published on Aug. 7, 2008 discloses a wire-less inductive device. The inductive device comprises a magnetic core embedded in top and bottom headers or substrates, a plurality of through-hole vias or a plurality of connecting elements disposed around the magnetic core.

U.S. Patent Application Publication No. 2007/0111598 published on May 17, 2007 discloses a receptacle assembly having a substrate and a plurality of electrical components, e.g., magnetic elements, resistive elements, capacitive elements disposed on the substrate.

Hence, a modular jack connector having improved magnetic module is highly desired.

SUMMARY OF THE INVENTION

Accordingly, an object of the present invention is to provide a modular jack connector having an improved magnetic module taking less space and having improved characteristics.

In order to achieve the object set forth, a modular jack connector in accordance with the present invention includes an an insulative housing defining a receiving cavity, a contact module received in the receiving cavity of the insulative housing. The contact module includes a paddle board having opposite first and second side faces and a plurality of vias extending through the first and second side faces. Each of the first and second side faces is provided with a conductive section. The contact module includes a magnetic module comprising a plurality of magnetic cores embedded in the paddle board, and a plurality of PCB layout traces arranged in each of the first and second side faces of the paddle board. The PCB layout traces on each of the first and second side faces comprise a primary group of PCB layout traces having one group of tips extending to a position adjacent to corresponding magnetic core to form a magnetic field and another group of tips connected to the conductive section, and a secondary group of PCB layout traces having one group of tips extending to a position adjacent to corresponding magnetic core to form a magnetic field and another group of tips connected to the vias. The contact module includes a plurality of contacts attached to the first side face of the paddle board and soldered on the conductive section of the first side face, and an electronic component attached to the second side face of the paddle board and soldered on the conductive section of the second side face. The contact module includes a converting module secured to the second side face of the paddle board and having a plurality of converting terminals inserting through said vias.

The layout traces arranged on the first side face of the paddle board could be connected with the contacts and the vias, and the layout traces arranged on the second side face of the paddle board could be connected with the electronic component, e.g. capitor, resistor, and the vias. The converting terminals of the converting module could be connected with the contacts and the electronic component through the vias and the PCB layout traces arranged on opposite side faces. By forming the embedded magnetic cores, PCB layout traces, first and second conductive sections and vias on the paddle board, the contacts, the electronic component and the converting module, which are necessary in a modular jack connector, could establish appropriate connection thereamong via such a paddle board only. Such a contact module has a simple configuration, takes less space and is able to obtain improved characteristics.

Other objects, advantages and novel features of the invention will become more apparent from the following detailed description when taken in conjunction with the accompanying drawings.

DETAILED DESCRIPTION OF THE PREFERRED EMBODIMENT

Figure 1:
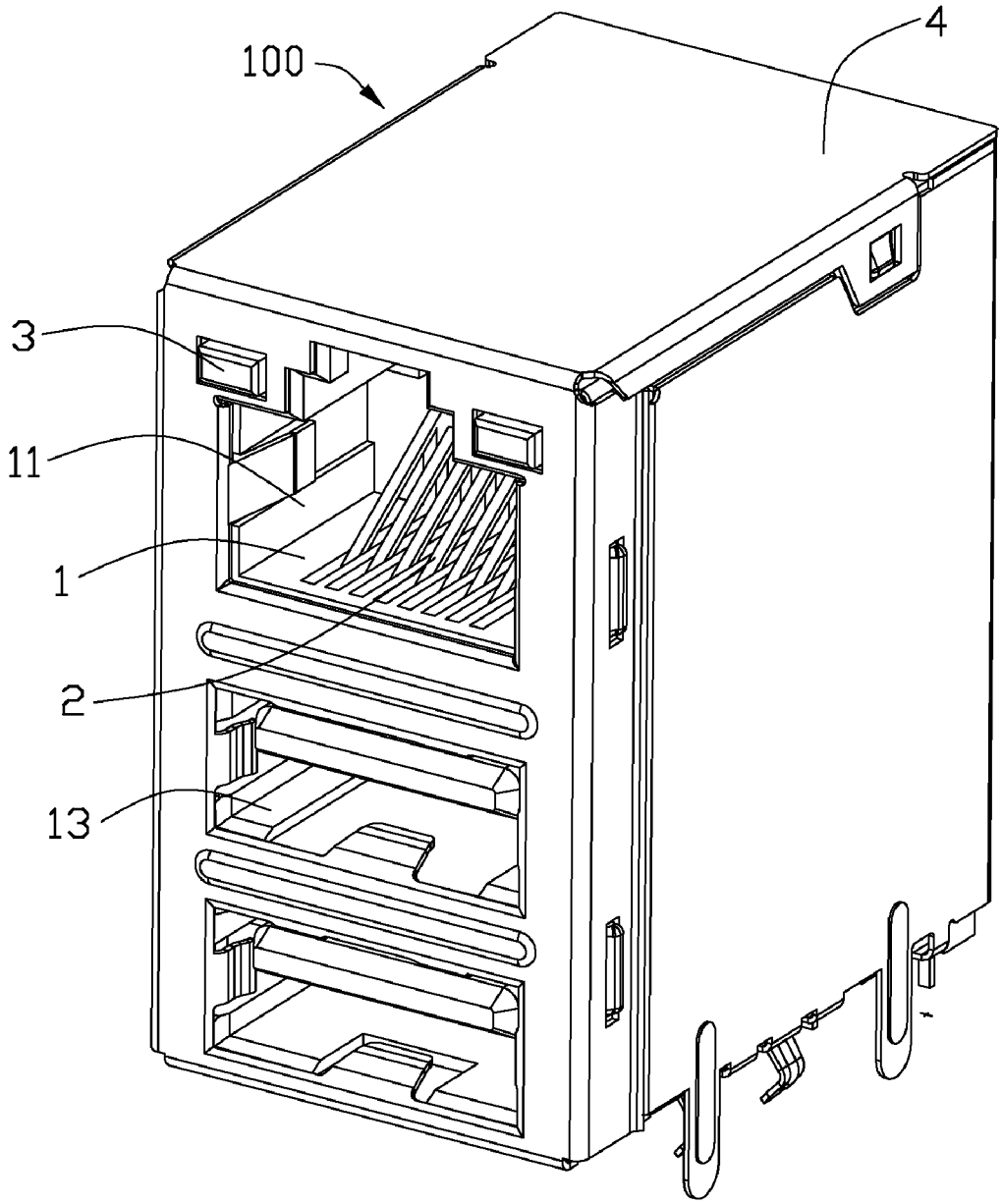
FIG. 1 is an assembled perspective view showing an electrical connector in accordance with the present invention.

Reference will now be made in detail to the preferred embodiment of the present invention. Referring to FIG. 1, a modular jack connector 100 comprises an insulative housing 1, a contact module 2, a pair of LEDs 3 and a shielding shell 4.

Figure 2:
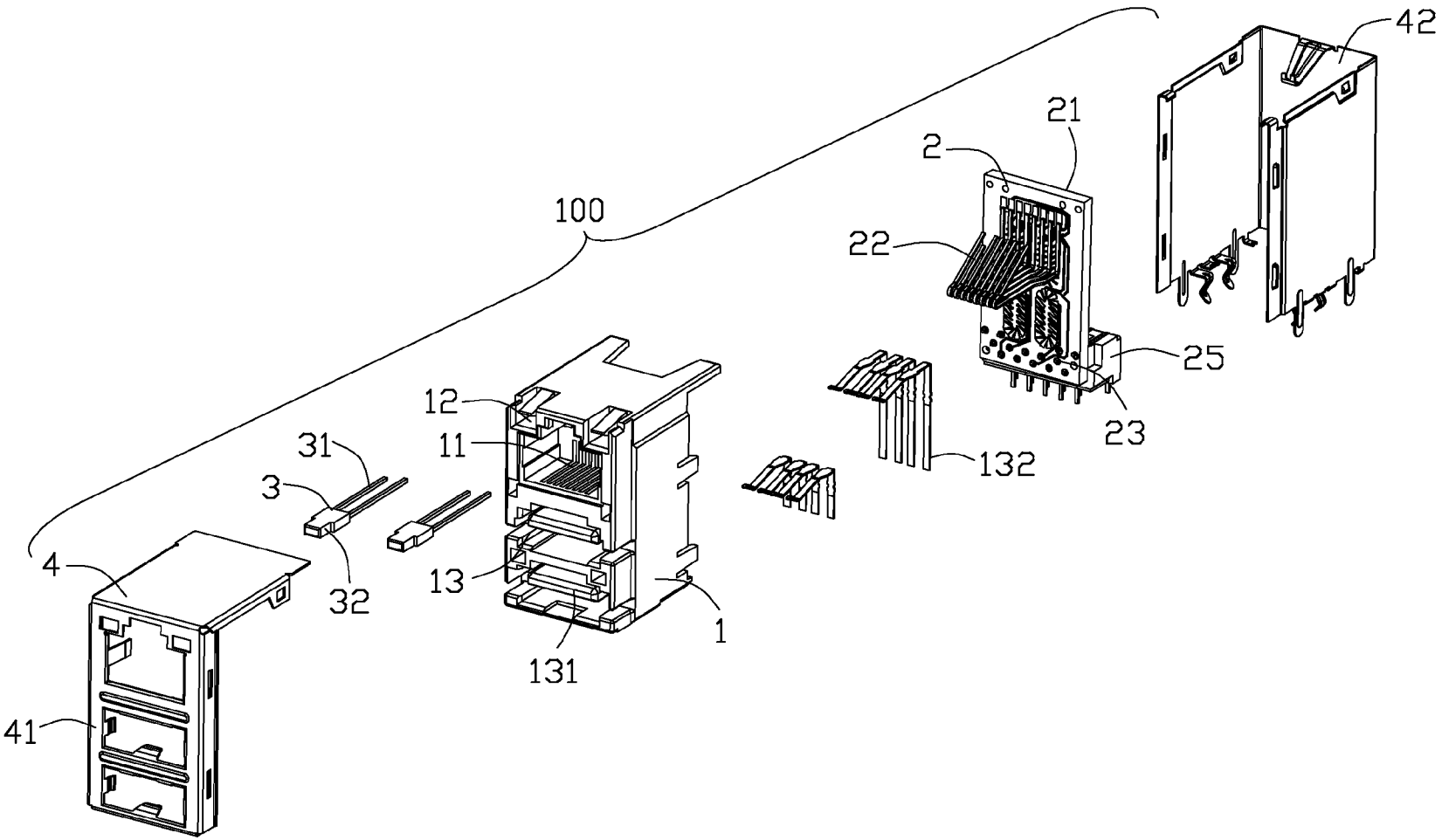
FIG. 2 is an exploded perspective view showing the electrical connector.
Figure 3:
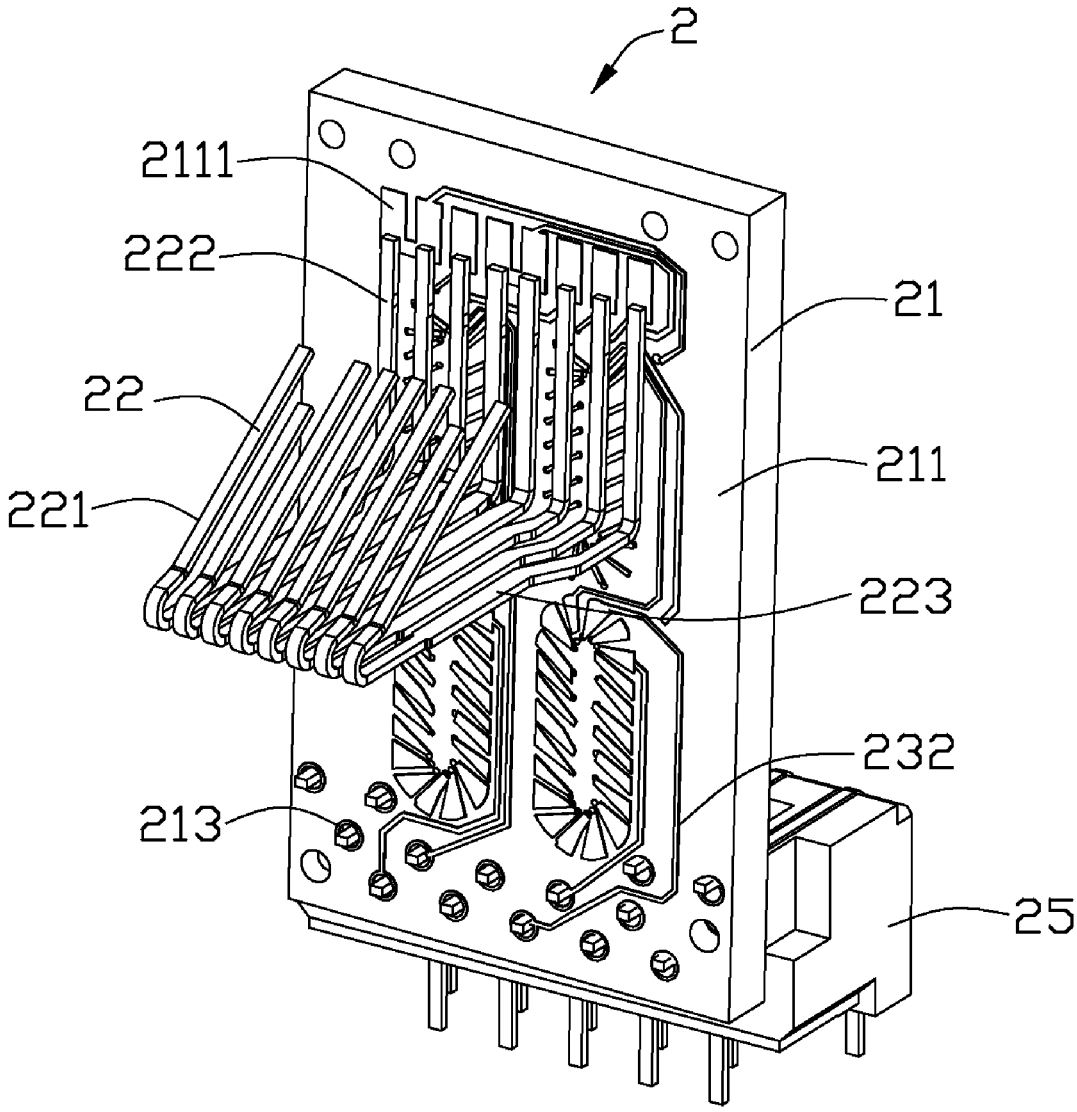
FIG. 3 is an assembled perspective view showing the contact module.

Referring to FIGS. 1-2, the insulative housing 1 defines a receiving port 13, a cavity 11 stacked above the receiving port 13 and a pair of inserting recesses 12 defined above the cavity 11. The receiving port 13 has a tongue portion 131 formed in the receiving port 13. The electrical connector 100 has a plurality of USB terminals 132 received in the receiving port 13.

Referring to FIGS. 3-6, the contact module 2 comprises a paddle board 21 having a first side face 211 and an opposite second side face 212, a magnetic module 23, a plurality of contacts 22 mounted at the first side face 211 of the paddle board 21, electronic components 24 and a converting module 25 mounted at the second side face 212 of the paddle board 21.

The paddle board 21 has an array of conductive pads 2111 disposed at an upper portion of the first side face 211, a conductive region 2121 formed at an upper portion of the second side face 212, and a plurality of conducive holes 213 defined at a lower portion of the paddle board 21 and extending through the first and second side faces 211, 212.

Figure 5:
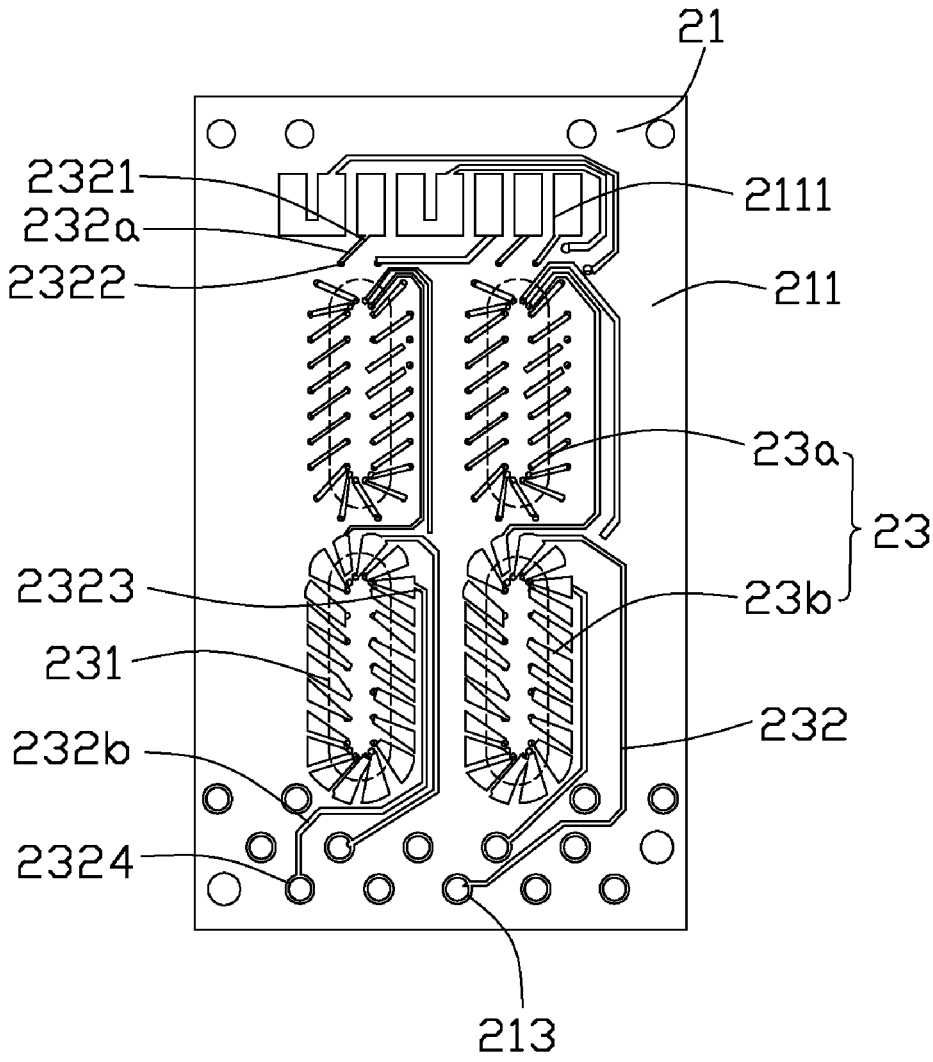
FIG. 5 is a schematic view showing a first side face of the paddle board.

The magnetic module 23 comprises four magnetic cores 231 embedded in the paddle board 21, a group of first PCB layout traces 232 and a group of second PCB layout traces 233 respectively disposed on the first and second side faces 21, 22 of the paddle board 21. FIG. 5 is a schematic view showing the first side face 211 of the paddle board 21. The group of first PCB layout traces 232 comprise a primary group of first PCB layout traces 232*a* having one group of tips 2322 extending to a position adjacent to the magnetic cores 231 for forming a magnetic field and generating inductance, and another group of opposite tips 2321 electrically connected with the conductive pads 2111 for transmitting signals. The group of first PCB layout traces 232 further comprise a secondary group of first PCB layout traces 232*b* having one group of tips 2323 extending to a position adjacent to the magnetic cores 231 for forming a magnetic field and generating inductance, and another group of opposite tips 2324 electrically connected with the through holes 213 for improving the electrical compensation.

Figure 6:
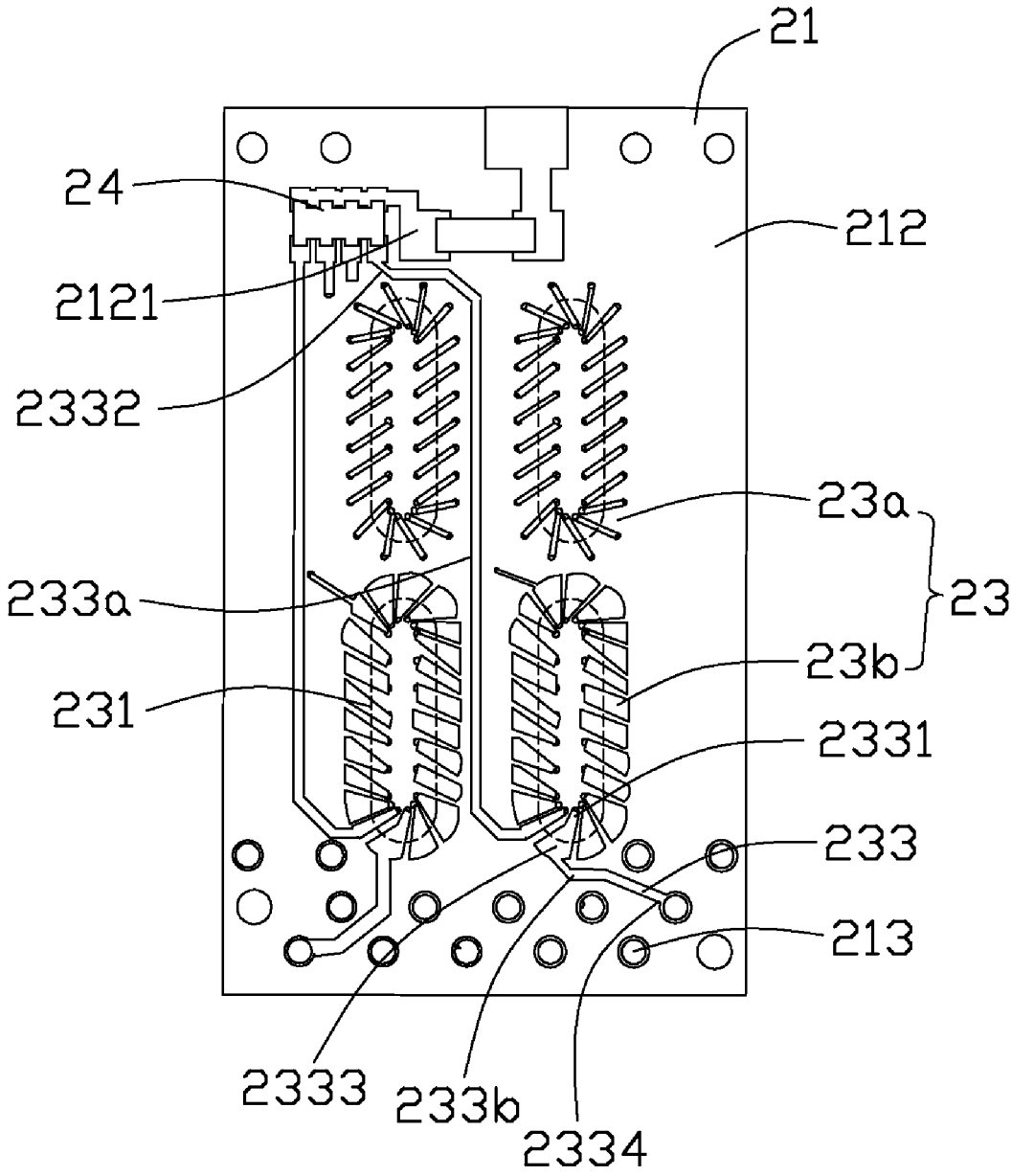
FIG. 6 is a schematic view showing a second side face of the paddle board.

FIG. 6 is a schematic view showing the second side face 212 of the paddle board 21. The group of second PCB layout traces 233 comprise a primary group of second PCB layout traces 233*a* having one group of tips 2331 extending to a position adjacent to the magnetic cores 231 for forming a magnetic field and generating inductance, and another group of opposite tips 2332 electrically connected with the conductive region 2121 for transmitting signals. The group of second PCB layout traces 233 further comprise a secondary group of second PCB layout traces 233*b* having one group of tips 2333 extending to a position adjacent to the magnetic cores 231 for forming a magnetic field and generating inductance, and another group of opposite tips 2334 electrically connected with the through holes 213 for improving the electrical compensation.

The magnetic cores 231 include a pair of upper magnetic cores and a pair of lower magnetic cores. Each of the upper magnetic cores and the associated PCB layout traces constitute a common mode choke 23*a*. Each of the lower magnetic cores and the associated PCB layout traces constitute a transformer 23*b*.

Each contact 22 includes an oblique contact portion 221, a vertical soldering portion 222 and a horizontal connecting portion 223 between the contact portion 221 and the soldering portion 222.

Figure 4:
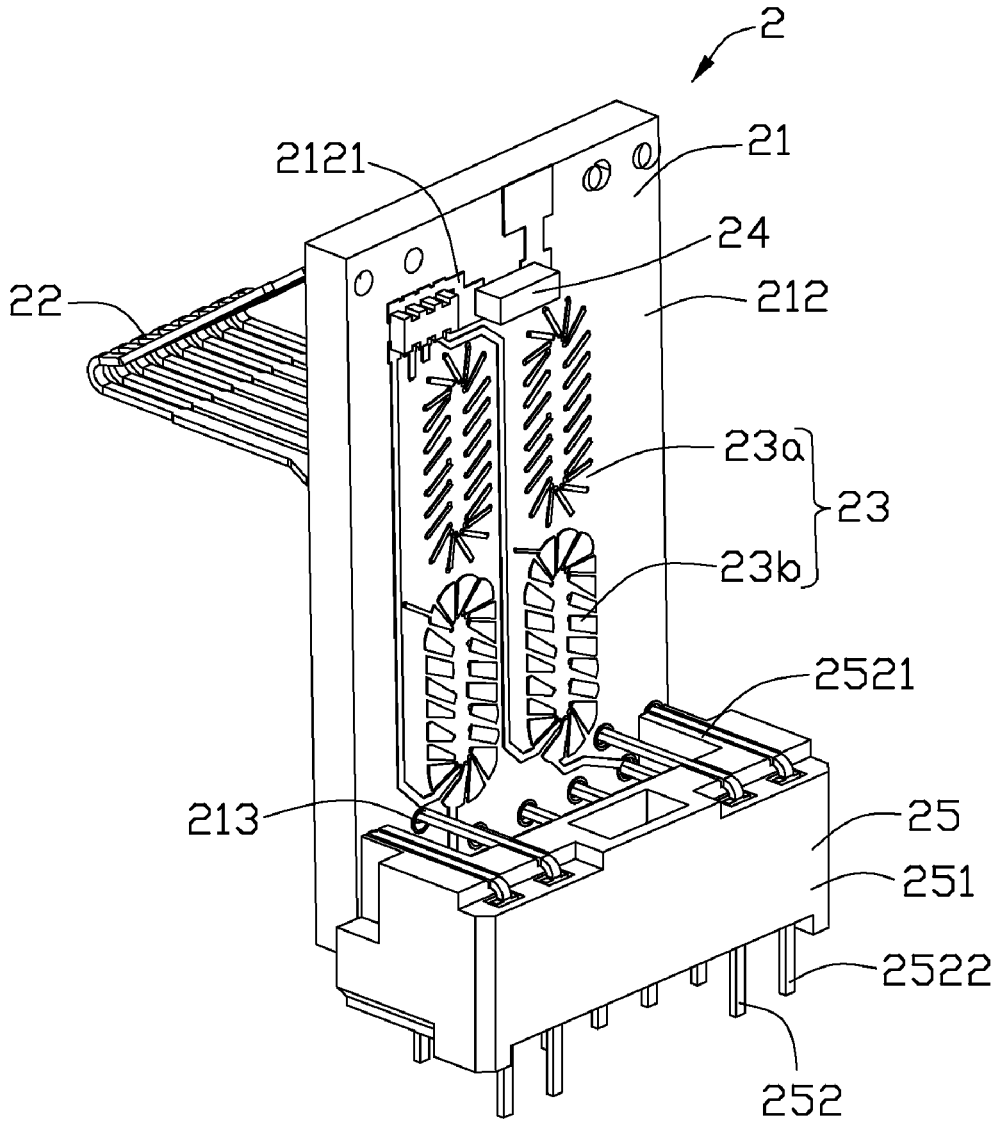
FIG. 4 is a view similar to FIG. 3, taken from another aspect.

Referring to FIG. 4, the converting module 25 comprises a body portion 251 and a plurality of L-shaped converting terminals 252 secured to the body portion 251. Each converting terminal 252 comprises a horizontal conductive portion 2521 and a vertical tail portion 2522.

In assembling of the contact module 2, the contacts 22 are soldered onto the paddle board 21, with the soldering portions 222 soldered onto the conductive pads 2111. The electronic component 24, e.g. capacitor, resistor, ets., is soldered onto the conductive region 2121. The converting module 25 is secured to the paddle board 21, with the conductive portions 2521 of the converting terminal 252 inserting through the conductive holes 213.

Each LED 3 comprises an emitting portion 32 and a pair of feet 31 extending from the emitting portion 32. The shielding shell 4 comprises a first and a second shielding shells 41, 42.

In assembling of the electrical connector 100, the contact module 2 is assembled to the insulative housing 1, with the contact portions 221 of the contacts 22 retained in the cavity 11. The pair of LEDs 3 are mounted in the inserting recesses 12, with the emitting portion 32 exposed in the inserting recess 12 and the feet 31 electrically connected with the paddle board 21. The plurality of USB terminals 132 are secured to the tongue portion 131 of the receiving port 13. The first and second shielding cages 41, 42 are mounted on the insulative housing 1.

By forming the embedded magnetic cores 231, PCB layout traces 232, 233, first and second conductive sections 2111, 2121, and through holes 213 on the paddle board 21, the contacts 22, the electronic component 24 and the converting module 25, which are necessary in a modular jack connector, could establish appropriate connection thereamong via such the paddle board 21 only. Such a contact module 2 has a simple configuration, takes less space and is able to obtain improved characteristics.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A modular jack connector comprising:

an insulative housing defining a receiving cavity;

a contact module received in the receiving cavity of the insulative housing, said contact module comprising:

a paddle board having opposite first and second side faces and a plurality of vias extending through the first and second side faces, each of the first and second side faces being provided with a conductive section; and a magnetic module comprising a plurality of magnetic cores embedded in the paddle board, and a plurality of PCB layout traces arranged in each of the first and second side faces of the paddle board, said PCB layout traces on each of the first and second side faces comprising a primary group of PCB layout traces having one group of tips extending to a position adjacent to corresponding magnetic core to form a magnetic field and another group of tips connected to the conductive section, and a secondary group of PCB layout traces having one group of tips extending to a position adjacent to corresponding magnetic core to form a magnetic field and another group of tips connected to the vias;

a plurality of contacts attached to the first side face of the paddle board and soldered on the conductive section of the first side face;

an electronic component attached to the second side face of the paddle board and soldered on the conductive section of the second side face; and a converting module secured to the second side face of the paddle board and having a plurality of converting terminals inserting through said vias.

2. The modular jack connector as claimed in claim 1, wherein said plurality of magnetic cores comprise a pair of upper magnetic cores disposed adjacent to the conductive sections and a pair of lower magnetic cores disposed adjacent to the vias, and wherein each upper magnetic core and associated PCB layout traces constitute a common mode choke, and wherein each lower magnetic core and associated PCB layout traces constitute a transformer.

3. An electrical connector assembly comprising:

an insulative housing;

a plurality of contacts disposed in the housing;

a paddle board having opposite first and second side faces and a plurality of vias extending through the first and second side faces, and the first side face forming a conductive section thereon;

a magnetic module comprising at least one loop type magnetic core embedded in the paddle board, and a plurality of PCB layout traces arranged on each of the first and second side faces of the paddle board along the magnetic core under condition that at least one of said layout traces is connected to a corresponding one of said vias and is essentially oblique to the magnetic core as viewed from a direction vertical to the paddle board side faces so as to form a pseudo winding along the magnetic core and further a corresponding pseudo magnetic field thereof; wherein at least one of said PCB layout traces connects to the conductive section.

4. The electrical connector assembly as claimed in claim 3, wherein the PCB layout traces on the first side face extend in a first oblique direction, and the PCB layout traces on the second side face extend in a second oblique direction.

5. The electrical connector assembly as claimed in claim 3, wherein said PCB layout traces comprise first and second groups constituting part of a common mode choke and part of a transformer, respectively, and the PCB layout traces of the first group are wider than those of the second group.

6. The electrical connector assembly as claimed in claim 3, wherein the corresponding one of the vias is essentially located at an end of the at least one PCB layout trace.

* * * * *